US010568430B1

(12) United States Patent
Sun

(10) Patent No.: US 10,568,430 B1
(45) Date of Patent: Feb. 25, 2020

(54) ROCKING DIRECTOR'S CHAIR

(71) Applicant: Benlong Sun, Zhejiang (CN)

(72) Inventor: Benlong Sun, Zhejiang (CN)

( * ) Notice: Subject to any disclaimer, the term of this patent is extended or adjusted under 35 U.S.C. 154(b) by 0 days.

(21) Appl. No.: 16/553,229

(22) Filed: Aug. 28, 2019

(51) Int. Cl.
*A47C 3/025* (2006.01)
*A47C 4/28* (2006.01)

(52) U.S. Cl.
CPC ..... *A47C 3/025* (2013.01); *A47C 4/283* (2013.01)

(58) Field of Classification Search
CPC ..... A47C 3/02; A47C 3/025; A47C 3/029; A47C 4/283
See application file for complete search history.

(56) References Cited

U.S. PATENT DOCUMENTS

| | | | | |
|---|---|---|---|---|
| D142,094 | S * | 8/1945 | Kirkpatrick | D6/344 |
| 3,948,555 | A * | 4/1976 | Lesser | A47C 3/02 297/39 |
| 5,382,080 | A * | 1/1995 | Gamberini | A47C 3/025 297/338 |
| 5,738,409 | A * | 4/1998 | Bursik | A47C 3/02 297/265.1 |
| 9,060,611 | B2 * | 6/2015 | Grace | A47C 3/025 |
| 9,282,824 | B2 * | 3/2016 | Grace | A47C 3/027 |
| 9,795,217 | B2 * | 10/2017 | Grace | A47C 7/70 |
| 9,936,810 | B2 * | 4/2018 | Lv | A47C 4/18 |
| 2019/0029430 | A1 * | 1/2019 | Yang | A47C 4/44 |
| 2019/0082844 | A1 * | 3/2019 | Zhu | A47C 3/0251 |

* cited by examiner

*Primary Examiner* — Philip F Gabler
(74) *Attorney, Agent, or Firm* — WPAT, P.C., Intellectual Property Attorneys; Anthony King

(57) ABSTRACT

A rocking director's chair comprises a chair frame and two rocking bar assemblies, wherein the chair frame is sleeved with a chair cloth, and the two rocking bar assemblies are mounted on the left side and the right side of a rear part of the chair frame.

10 Claims, 11 Drawing Sheets

ROCKING DIRECTOR'S CHAIR

BACKGROUND OF THE INVENTION

1. Technical Field

The invention relates to a rocking director's chair.

2. Description of Related Art

With the improvement of the living standard, existing director's chairs which cannot rock forwards or backwards cannot meet the requirements of people anymore.

BRIEF SUMMARY OF THE INVENTION

The technical issue to be settled by the invention is to overcome the defects of the prior art by providing a rocking director's chair which can be unfolded or folded like common director's chairs and can also rock forwards or backwards like rocking chairs.

The technical solution adopted by the invention to settle the above technical issue is as follows:

A rocking director's chair comprises a chair frame and two rocking bar assemblies, wherein the chair frame is sleeved with a chair cloth, and the two rocking bar assemblies are mounted on the left side and the right side of a rear part of the chair frame.

The chair frame comprises two back elbow tubes, two foot elbow tubes, four connecting pieces and two U-shaped tubes, wherein the two back elbow tubes are fixedly connected with the two foot elbow tubes respectively, open ends of the two U-shaped tubes face downwards and are riveted together in a crossed manner, two sides of a lower end of each U-shaped tube are respectively hinged to the back elbow tube and the foot elbow tube on the corresponding side, and a front side and a rear side of an upper part of each U-shaped tube are respectively hinged to the back elbow tube and the foot elbow tube on the corresponding side through two connecting pieces.

Each rocking bar assembly comprises an upper rocking bar, a torsion spring assembly, a lower rocking bar, a lower rocking bar fixing base, a bottom tube and a bottom tube base, wherein the upper rocking bar has an upper end hinged to an upper part of the corresponding foot elbow tube through an upper rocking bar fixing base as well as a lower end connected to an upper end of the lower rocking bar through the torsion spring assembly, a lower end of the lower rocking bar is hinged to a rear end of the bottom tube through the lower rocking bar fixing base, the bottom tube is located under the corresponding foot elbow tube, the bottom tube base is arranged on a front part of the bottom tube and is connected with the chair frame through a shaft, and the shaft has two ends provided with bearings and is fixed to the corresponding foot elbow tube; and the bottom surface of the lower rocking bar fixing base and the bottom surface of the bottom tube base are planes and are always in contact with the ground.

Furthermore, each back elbow tube is in a horizontal Z shape, and each foot elbow tube is in an L shape; a rear end of a horizontal part of each back elbow tube is welded to an upper end of a vertical part of the foot elbow tube on the corresponding side; and a lower end of a front vertical part of each back elbow tube is welded to a front end of a horizontal part of the foot elbow tube on the corresponding side, and a foot pad is riveted to a welding joint through a rivet.

Furthermore, a cushion is mounted at a rear end of a lower part of each foot elbow tube of the chair frame; the chair frame swings backwards under manual action; and when the cushions make contact with the bottom tubes, the chair frame stops swinging backwards.

Furthermore, the connecting piece on the right side of a rear end of the chair frame is formed with a slot, a stop block is mounted between the foot elbow tube on the right and the U-shaped tubes, and when the chair frame is unfolded, the rivet slides in the slot of the connecting piece; and when the chair frame is completely unfolded, the stop block abuts against the U-shaped tubes.

Furthermore, each torsion spring assembly comprises an upper torsion spring cover, a torsion spring and a lower torsion spring cover, wherein the upper torsion spring cover and the lower torsion spring cover are fastened together and are able to rotate relative to each other, and the torsion spring is mounted in the upper torsion spring cover and the lower torsion spring cover which are fastened together. The lower ends of the upper rocking bars are inserted into round holes of the upper torsion spring covers and are riveted on the upper torsion spring covers. Upper ends of steel wires of the torsion springs are inserted into the upper rocking bars. The upper ends of the lower rocking bars are inserted into round holes of the lower torsion spring covers and are riveted on the lower torsion spring covers. Lower ends of the steel wires of the torsion springs are inserted into the lower rocking bars.

Furthermore, each bottom tube base is connected with the chair frame through a shaft, wherein the middle of the shaft is fixed to the corresponding foot elbow tube, the left end and the right end of the shaft are mounted on the bottom tube base respectively through a bearing, and the bottom tube base is able to rotate around the shaft.

The invention has the following beneficial effect: the rocking director's chair can be unfolded or folded like common director's chairs and can also rock forwards or backwards like rocking chairs.

DETAILED DESCRIPTION OF THE INVENTION

The invention is further described below with reference to the accompanying drawings.

Referring to FIGS. 1-11, a rocking director's chair comprises a chair frame A and two rocking bar assemblies B. The chair frame A is sleeved with a chair cloth. The two rocking bar assemblies B are respectively mounted on the left side and the right side of a rear part of the chair frame A.

Figure 1:
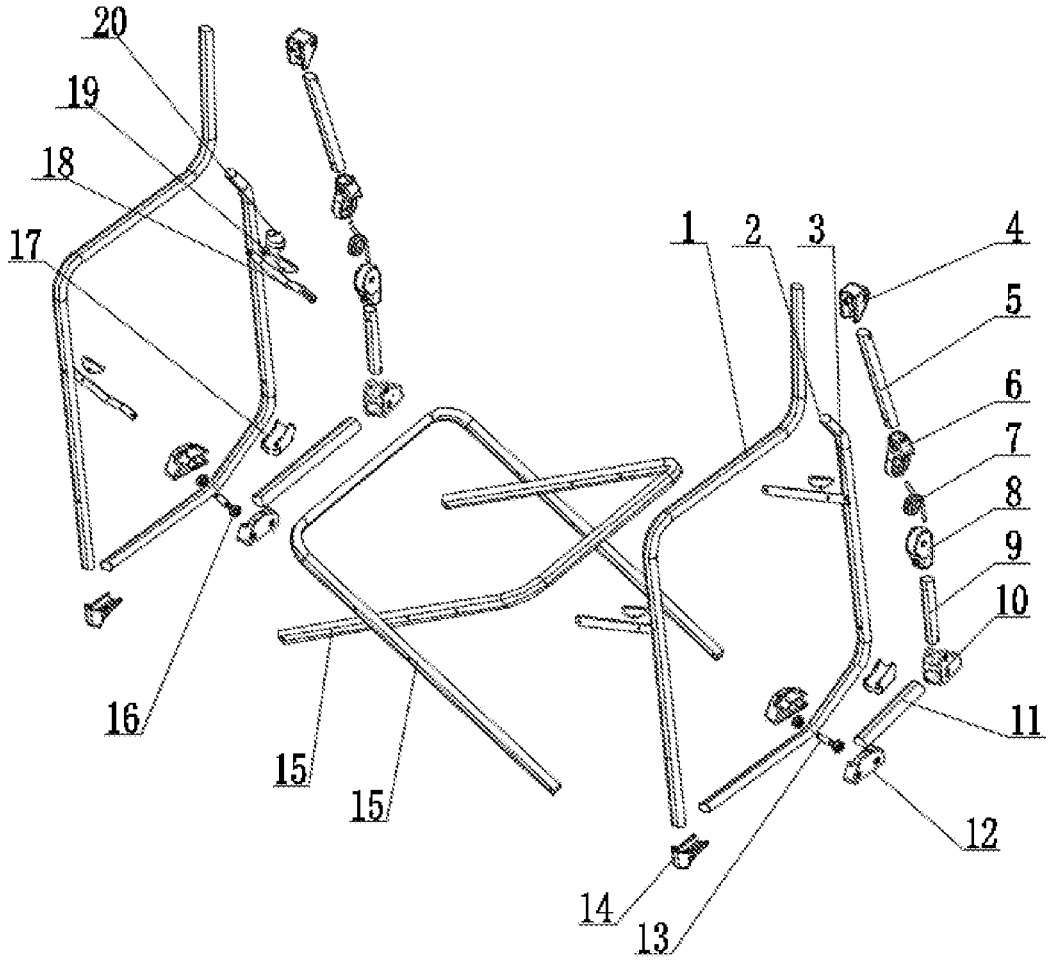
FIG. 1 is an exploded view of the invention.
Figure 2:
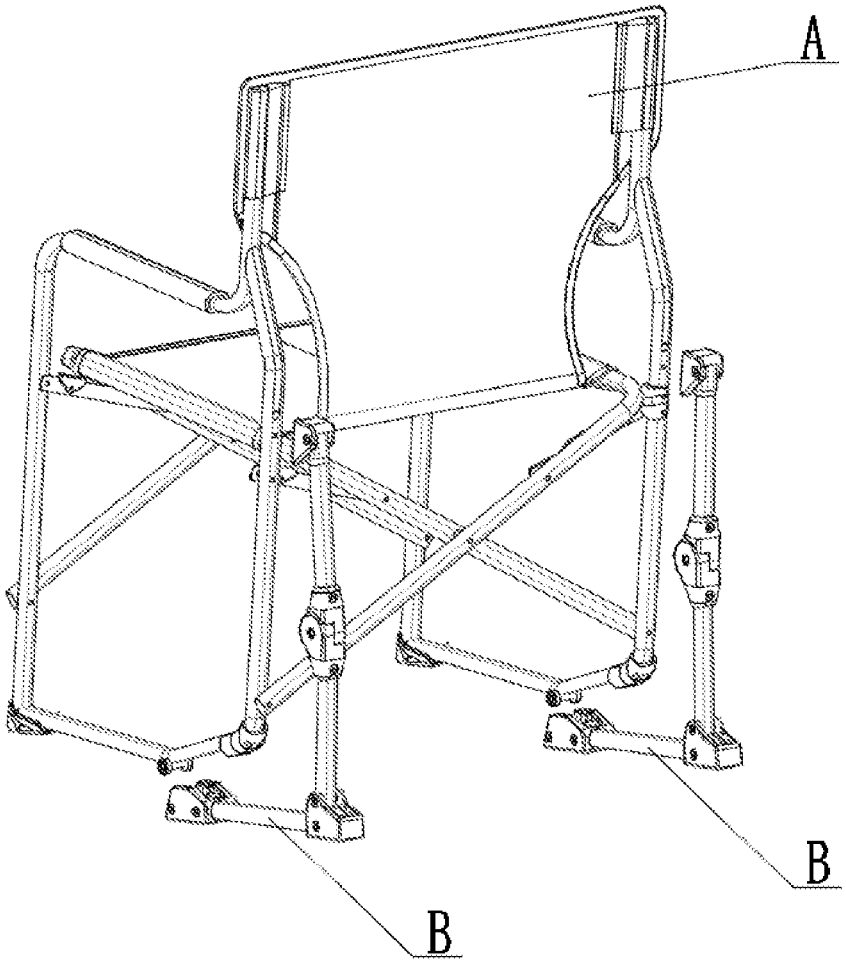
FIG. 2 is a view of a chair frame and rocking bar assemblies separated from the chair frame.
Figure 3:
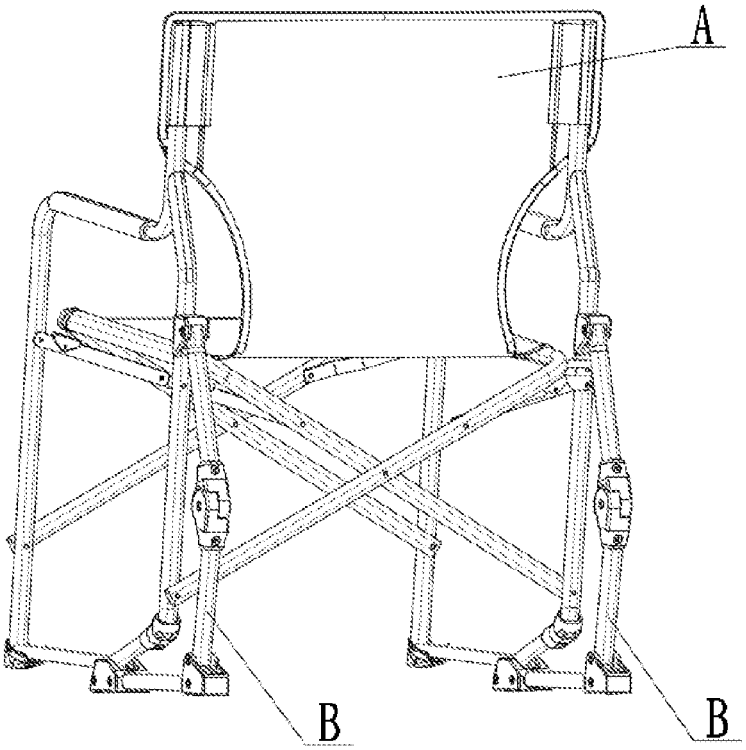
FIG. 3 is a view of the chair frame and the rocking bar assemblies connected with the chair frame.
Figure 4:
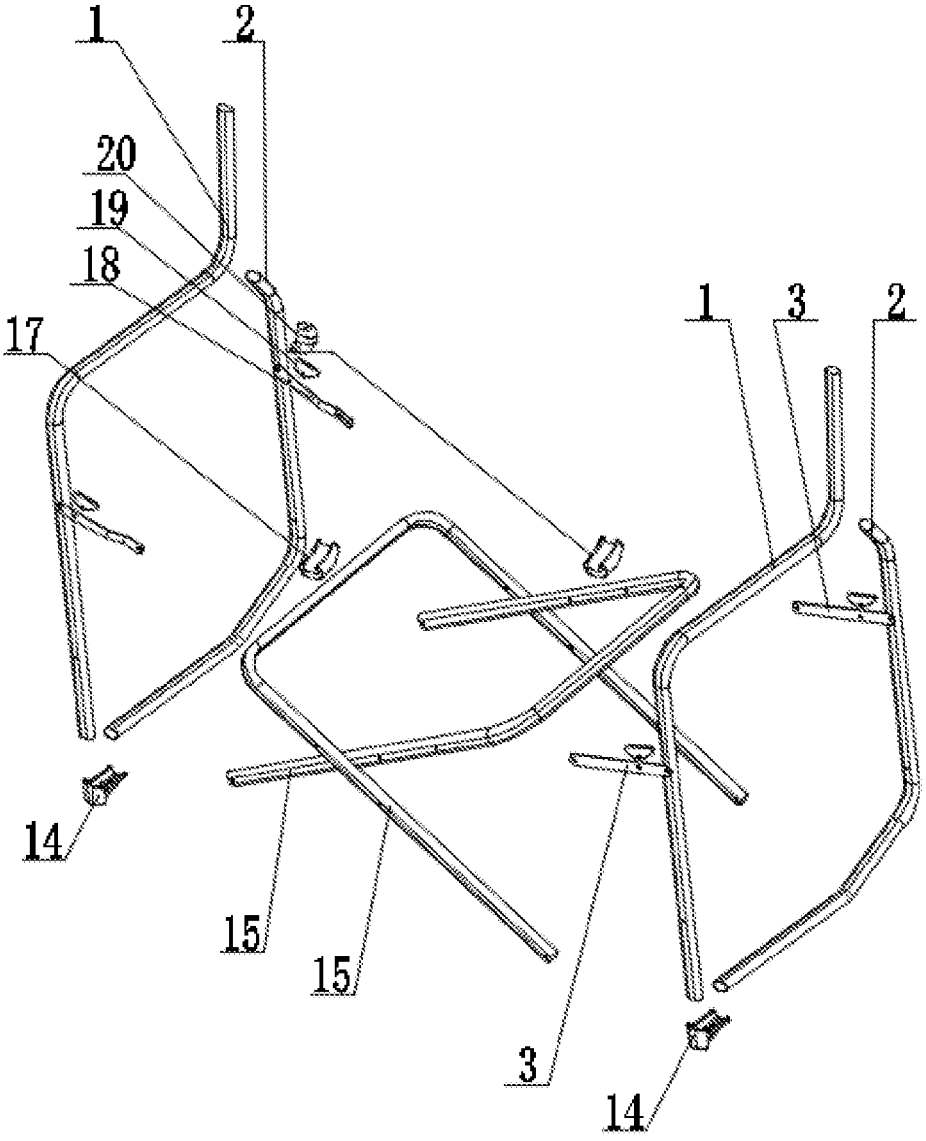
FIG. 4 is an exploded view of the chair frame.

As shown in FIG. 4, the chair frame A comprises two back elbow tubes 1, two foot elbow tubes 2, two connecting pieces 3, two connecting pieces 18, two U-shaped tubes 15 and two foot pads 14, wherein one back elbow tube 1 and one foot elbow tube 2 are fixed together through welding, and one foot pad 14 is riveted on a welding joint of lower parts of the two tubes through a rivet; and one connecting piece 3 is riveted on an upper part of the back elbow tube 1 through a rivet, and the other connecting piece 3 is riveted on an upper part of the foot elbow tube 2 through a rivet, so that a left chair frame is formed. The other back elbow tube 1 and the other foot elbow tube 2 are fixed together through welding, and the other foot pad 14 is riveted to a welding joint of lower parts of the two tubes through a rivet; and one connecting piece 18 is riveted on an upper part of the back elbow tube 1 through a rivet, and the other connecting piece 18 is riveted to an upper part of the foot elbow tube 2 through a rivet, so that a right chair frame is formed. An open end of one U-shaped tube 15 has lower parts respectively riveted on the lower parts of the back elbow tube 1 and the foot elbow tube 2 of the left chair frame through rivets, as well as upper parts respectively riveted on the two connecting pieces 18 of the right chair frame through rivets. An open end of the other U-shaped tube 15 has lower parts respectively riveted on the lower parts of the back elbow tube 1 and the foot elbow tube 2 of the right chair frame through rivets, as well as upper parts respectively riveted on the two connecting pieces 3 of the left chair frame through rivets. The two U-shaped tubes are riveted together in a crossed manner, so that the left chair frame and the right chair frame are connected.

Figure 5:
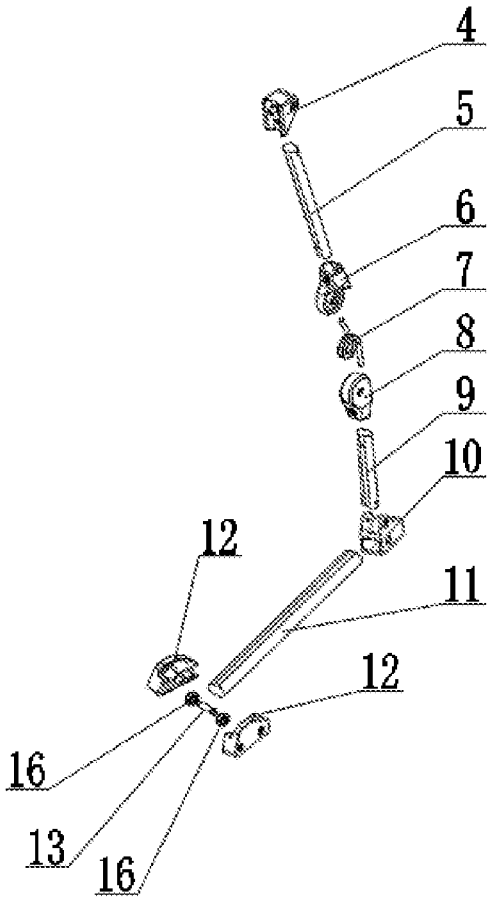
FIG. 5 is an exploded view of each rocking bar assembly.
Figure 6:
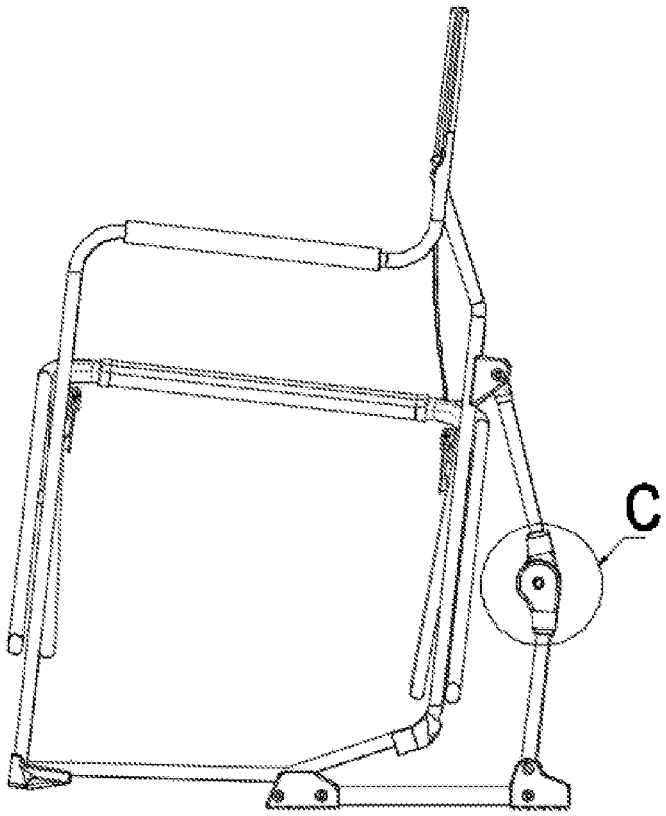
FIG. 6 is a view of the invention in a natural stationary state.
Figure 7:
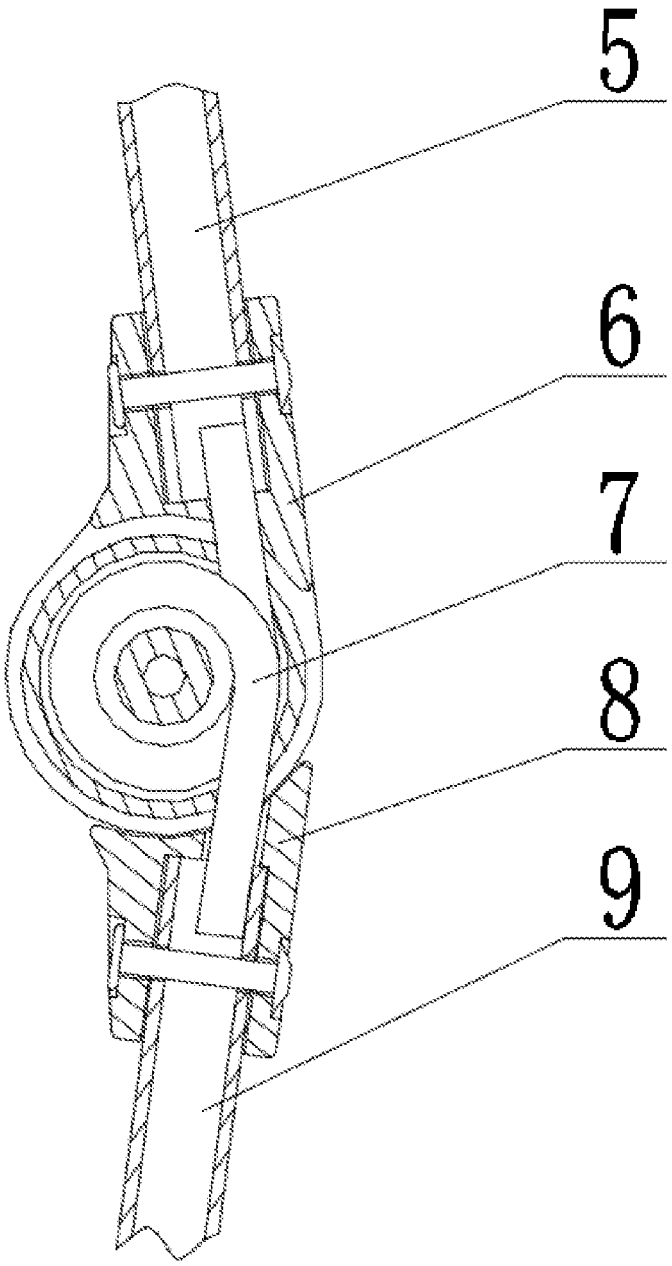
FIG. 7 is an enlarged view of part C in FIG. 6.

As shown in FIG. 5, each rocking bar assembly B comprises an upper rocking bar fixing base 4, an upper rocking bar 5, an upper torsion spring cover 6, a torsion spring 7, a lower torsion spring cover 8, a lower rocking bar 9, a lower rocking bar fixing base 10, a bottom tube 11, a bottom tube base 12, and two bearings 16, wherein the upper rocking bar fixing base 4 is connected to the upper part of the corresponding foot elbow tube 2 through a rivet so as to be fixed, an upper end of the upper rocking bar 5 is connected into a slot of the upper rocking bar fixing base 4 through a rivet and is able to rotate around the axis of the rivet, and a lower end of the upper rocking bar 5 is inserted into a round hole of the upper torsion spring 6 and is integrally fixed in the round hole through a rivet, as shown in FIG. 6; the lower torsion spring cover 8 is fastened on the upper torsion spring cover 6 through a rivet and is able to rotate around the axis of the rivet, and a cavity in which the torsion spring 7 is mounted is formed in the upper torsion spring cover 6 and the lower torsion spring cover 8 which are fastened together; an upper end of a steel wire of the torsion spring 7 is inserted into a small hole of the upper torsion spring cover 6 and enters the upper rocking bar 5, a lower end of the steel wire of the torsion spring 7 is inserted into a small hole of the lower torsion spring cover 8 and enters the lower rocking bar 9, and a ring part of the torsion spring is disposed around a boss located in the middle of the upper torsion spring cover 6, as shown in FIG. 6 and FIG. 7; an upper end of the lower rocking bar 9 is inserted into a round hole of the lower torsion spring cover 8 and is integrally fixed in the round hole through a rivet, and a lower end of the lower rocking bar 9 is connected into a slot of the lower rocking bar fixing base 10 through a rivet and is able to rotate around the axis of the rivet; the bottom tube 11 has a rear end inserted into the lower rocking bar fixing base 10 and a front end inserted into the bottom tube base 12, and the bottom tube 11, the lower rocking bar fixing base 10 and the bottom tube base 12 are integrally connected through rivets; each foot elbow tube of the chair frame is in an L shape and has two inflection points, a shaft 13 is connected with the bottom tube base 12 through the bearings 16, and the bottom tube base 12 is able to rotate around the shaft 13; and the shaft 13 is welded to the front inflection point on a lower part of the corresponding foot elbow tube 2.

A cushion 17 is mounted at the rear inflection point on the lower part of each foot elbow tube; the chair frame swings backwards under manual action; and when the cushions 17 make contact with the bottom tubes 11, the chair frame stops swinging backwards.

The connecting piece 18 on the right side of a rear end of the chair frame is formed with a slot, a stop block 20 is mounted between the foot elbow tube on the right and the U-shaped tubes, and when the chair frame is unfolded, the rivet slides in the slot of the connecting piece 18; and when the chair frame is completely unfolded, the stop block abuts against the U-shaped tubes 15.

Figure 8:
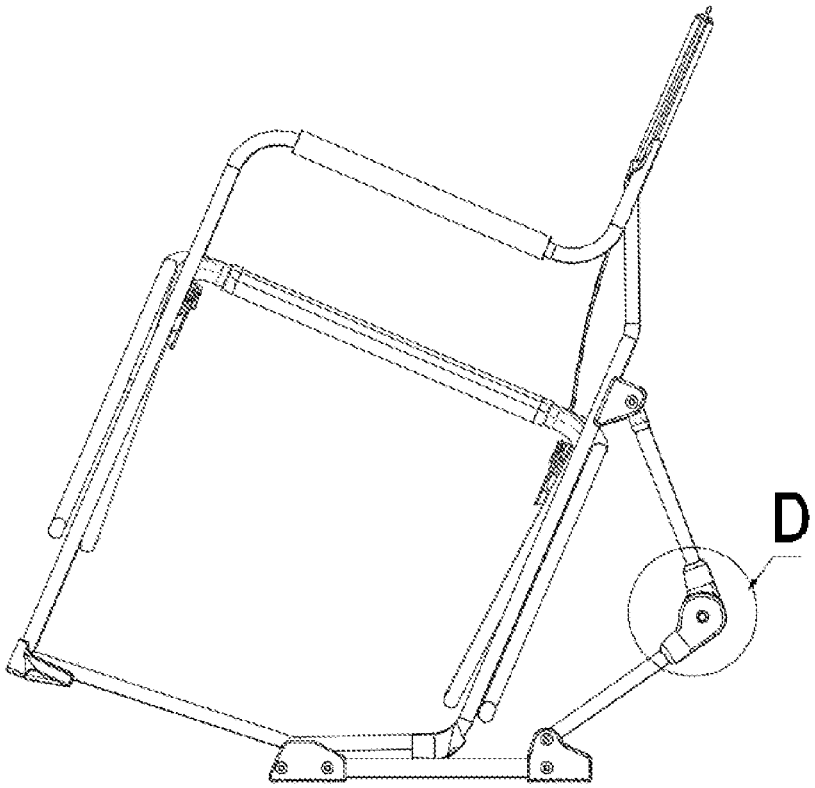
FIG. 8 is a view of the invention in a rocking state.
Figure 9:
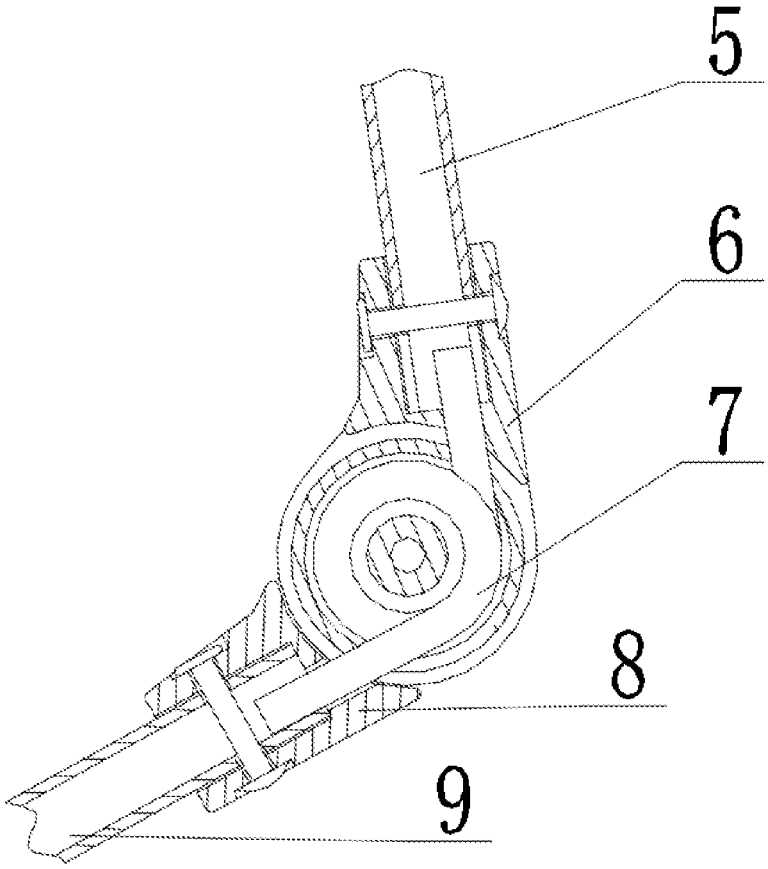
FIG. 9 is an enlarged view of part D in FIG. 8.

The forward and backward rocking process of the invention is as follows:

Due to the fact that the lower rocking bar fixing bases 10 and the bottom tube bases 12 are always in contact with the ground, when the lower rocking bars 9 connected with the lower rocking bar fixing bases 10 rotate, and the shafts 13 connected with the bottom tube bases 12 drive the while chair frame A to rotate synchronously, as shown in FIG. 8 and FIG. 9. When pushed backwards, the whole chair frame A rotates backwards around the shafts 13. At this moment, the upper rocking bar fixing bases 4 fixed on the foot elbow tubes 2 in the chair frame A push the upper rocking bars 5 to rotate around the axes of the rivets through which the upper rocking bar fixing bases 4 and the upper rocking bars 5 are connected, and press the upper torsion spring covers 6 downwards. Due to the fact that the upper torsion spring covers 6 are connected with the lower torsion spring covers 8 through rivets and are able to rotate around the axes of the rivets and that the lower ends of the lower rocking bars 9 connected with the lower torsion spring covers 8 are connected to the lower rocking bar fixing bases 10 in contact with the ground and are able to rotate around the axes of the connecting rivets, when the upper torsion spring covers 6 are stressed to move downwards, the lower rocking bars 9 and the lower torsion spring covers 8 synchronously rotate downwards around the axes of the rivets on the lower rocking bar fixing bases 10, and at the same time, the upper torsion spring covers 6 rotate relative to the lower torsion spring covers 8, the torsion springs 7 in the upper torsion spring covers 6 and the lower torsion spring covers 8 rotate inwards to be tightened till the foot elbow tubes 2 in the chair frame A abut against the bottom tubes 11, and at this moment, the rocking director's chair is rocked backwards to an extreme position. When released, the rocking director's chair stretch towards two sides under a restoration force from the torsion springs, and then the upper torsion spring covers 6 together with the upper rocking bars 5 thereon and the lower torsion spring covers 8 together with the lower rocking bars 9 thereon are driven to rotate in opposite directions. Due to the fact that the lower ends of the lower rocking bars 9 are connected to the lower rocking bar fixing bases 10 in contact with the ground, the upper rocking bars 5 continuously push the chair frame A to rotate upwards with the gradual increase of the angle between the upper rocking bars 5 and the lower rocking bars 9 till the chair frame A restores to the natural state. The rocking director's chair can continuously rock forwards or backwards by being downward pressed and released repeatedly.

Figure 10:
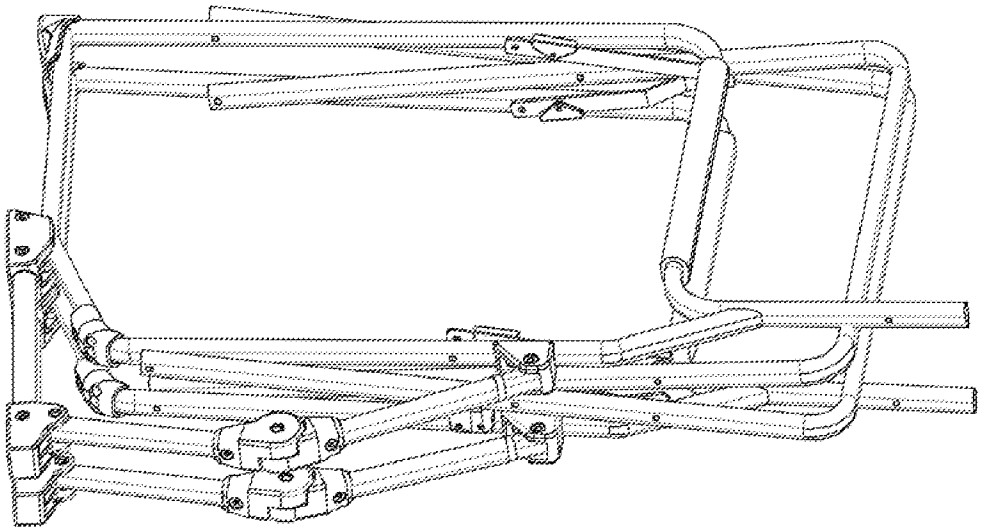
FIG. 10 is a folded view of the invention.

The folding and unfolding process of the invention as follows:

As shown in FIG. 10, when the rocking director's chair is to be folded, the chair cloth on the two U-shaped tubes 15 is grabbed with both hands to be forcibly pulled inwards, and at this moment, the two crossed U-shaped tubes rotate around the axes of the rivets at the junctions so as to be drawn close to each other. Due to the fact that the lower parts of the open end of each U-shaped tube 15 are riveted on the lower parts of the back elbow tube 1 and the foot elbow tube 2 of the chair frame on one side through rivets and that the upper parts of the open end of the U-shaped tube 15 are riveted on the two connecting pieces 3 of the chair frame on the other side through rivets, the back elbow tubes 1 and the foot elbow tubes 2 which are welded together on the two sides are driven by the two U-shaped tubes 15 to draw close to each other till the two U-shaped tubes 15 make contact with each other.

Figure 11:
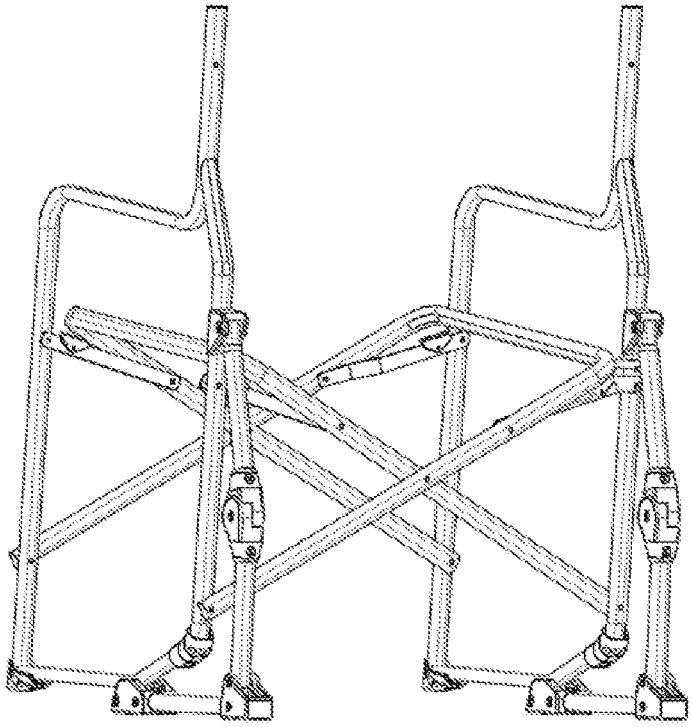
FIG. 11 is an unfolded view of the invention.

As shown in FIG. 11, when the chair frame is to be unfolded, the chair cloth on the U-shaped tubes 15 is grabbed with both hands to be forcibly stretched towards two sides, and at this moment, the back elbow tubes 1 and the foot elbow tubes 2 welded together on the two sides are driven by the two U-shaped tubes 15 to stretch towards two sides till the chair cloth around the two U-shaped tubes 15 is tensioned.

What is claimed is:

1. A rocking director's chair, comprising a chair frame and two rocking bar assemblies, wherein the chair frame is sleeved with a chair cloth, and the two rocking bar assemblies are mounted on a left side and a right side of a rear part of the chair frame;

the chair frame comprises two back elbow tubes, two foot elbow tubes, four connecting pieces and two U-shaped tubes, wherein the two back elbow tubes are fixedly connected with the two foot elbow tubes respectively, open ends of the two U-shaped tubes face downwards and wherein the two U-shaped tubes are riveted together in a crossed manner, two sides of a lower end of each said U-shaped tube are respectively hinged to the back elbow tube and the foot elbow tube on the corresponding side, and a front side and a rear side of an upper part of each said U-shaped tube are respectively hinged to the back elbow tube and the foot elbow tube on the corresponding side through two of said four connecting pieces;

each said rocking bar assembly comprises an upper rocking bar, a torsion spring assembly, a lower rocking bar, a lower rocking bar fixing base, a bottom tube, and a bottom tube base, wherein the upper rocking bar has an upper end hinged to an upper part of the corresponding foot elbow tube through an upper rocking bar fixing base as well as a lower end connected to an upper end of the lower rocking bar through the torsion spring assembly, a lower end of the lower rocking bar is hinged to a rear end of the bottom tube through the lower rocking bar fixing base, the bottom tube is located under the corresponding foot elbow tube, the bottom tube base is arranged on a front part of the bottom tube and is hinged to the corresponding foot elbow tube.

2. The rocking director's chair according to claim 1, wherein each said back elbow tube is in a horizontal Z shape, and each said foot elbow tube is in an L shape; a rear end of a horizontal part of each said back elbow tube is welded to an upper end of a vertical part of the foot elbow tube on the corresponding side; and a lower end of a front vertical part of each said back elbow tube is welded to a front end of a horizontal part of the foot elbow tube on the corresponding side, and a foot pad is riveted to a welding joint through a rivet.

3. The rocking director's chair according to claim 2, wherein a cushion is mounted at a rear end of a lower part of each said foot elbow tube of the chair frame; the chair frame swings backwards under manual action; and when the cushions make contact with the bottom tubes, the chair frame stops swinging backwards.

4. The rocking director's chair according to claim 2, wherein the connecting piece on a right side of a rear end of the chair frame is formed with a slot, a stop block is mounted between the foot elbow tube on the right and the U-shaped tubes, and when the chair frame is unfolded, the rivet slides in the slot of the connecting piece; and when the chair frame is completely unfolded, the stop block abuts against the U-shaped tubes.

5. The rocking director's chair according to claim 2, wherein each said torsion spring assembly comprises an upper torsion spring cover, a torsion spring and a lower torsion spring cover, wherein the upper torsion spring cover and the lower torsion spring cover are fastened together and are able to rotate relative to each other, and the torsion spring is mounted in the upper torsion spring cover and the lower torsion spring cover which are fastened together; the lower ends of the upper rocking bars are inserted into round holes of the upper torsion spring covers and are riveted on the upper torsion spring covers; upper ends of steel wires of the torsion springs are inserted into the upper rocking bars; the upper ends of the lower rocking bars are inserted into round holes of the lower torsion spring covers and are riveted on the lower torsion spring covers; and lower ends of the steel wires of the torsion springs are inserted into the lower rocking bars.

6. The rocking director's chair according to claim 2, wherein each said bottom tube base is connected with the chair frame through a shaft, a middle of the shaft is fixed to the corresponding foot elbow tube, a left end and a right end of the shaft are mounted on the bottom tube base respectively through a bearing, and the bottom tube base is able to rotate around the shaft.

7. The rocking director's chair according to claim 1, wherein a cushion is mounted at a rear end of a lower part of each said foot elbow tube of the chair frame; the chair frame swings backwards under manual action; and when the cushions make contact with the bottom tubes, the chair frame stops swinging backwards.

8. The rocking director's chair according to claim 1, wherein the connecting piece on a right side of a rear end of the chair frame is formed with a slot, a stop block is mounted between the foot elbow tube on the right and the U-shaped tubes, and when the chair frame is unfolded, the rivet slides in the slot of the connecting piece; and when the chair frame is completely unfolded, the stop block abuts against the U-shaped tubes.

9. The rocking director's chair according to claim 1, wherein each said torsion spring assembly comprises an upper torsion spring cover, a torsion spring and a lower torsion spring cover, wherein the upper torsion spring cover and the lower torsion spring cover are fastened together and are able to rotate relative to each other, and the torsion spring is mounted in the upper torsion spring cover and the lower torsion spring cover which are fastened together; the lower ends of the upper rocking bars are inserted into round holes of the upper torsion spring covers and are riveted on the upper torsion spring covers; upper ends of steel wires of the torsion springs are inserted into the upper rocking bars; the upper ends of the lower rocking bars are inserted into round holes of the lower torsion spring covers and are riveted on the lower torsion spring covers; and lower ends of the steel wires of the torsion springs are inserted into the lower rocking bars.

10. The rocking director's chair according to claim 1, wherein each said bottom tube base is connected with the chair frame through a shaft, a middle of the shaft is fixed to the corresponding foot elbow tube, a left end and a right end of the shaft are mounted on the bottom tube base respectively through a bearing, and the bottom tube base is able to rotate around the shaft.

* * * * *